US011074894B1

(12) United States Patent
Vega Mateos

(10) Patent No.: US 11,074,894 B1
(45) Date of Patent: Jul. 27, 2021

(54) VIBRATO SYSTEM FOR SOLID-BODY ELECTRIC GUITAR WITHOUT A HOUSING FOR VIBRATO

(71) Applicant: Isaac Vega Mateos, Palma de Mallorca (ES)

(72) Inventor: Isaac Vega Mateos, Palma de Mallorca (ES)

( * ) Notice: Subject to any disclaimer, the term of this patent is extended or adjusted under 35 U.S.C. 154(b) by 0 days.

(21) Appl. No.: 16/826,379

(22) Filed: Mar. 23, 2020

(30) Foreign Application Priority Data

Feb. 17, 2020 (ES) ..... ES202030134

(51) Int. Cl.
*G10D 3/153* (2020.01)
*G10D 1/08* (2006.01)
*G10D 3/04* (2020.01)

(52) U.S. Cl.
CPC ..... *G10D 3/153* (2020.02); *G10D 1/085* (2013.01); *G10D 3/04* (2013.01)

(58) Field of Classification Search
CPC ..... G10D 3/153; G10D 3/04; G10D 1/085
See application file for complete search history.

(56) References Cited

U.S. PATENT DOCUMENTS 4,928,564 A * 5/1990 Borisoff ..... G10D 3/153 84/313

* cited by examiner

*Primary Examiner* — Kimberly R Lockett
(74) *Attorney, Agent, or Firm* — Lucas & Mercanti, LLP

(57) ABSTRACT

A vibrato system for a solid-body electric guitar without a housing for vibrato is disclosed, wherein the solid-body guitar without a housing for vibrato has a neck, a body which in turn has a plurality of holes, and a plurality of strings joined at one end to the neck, having springs housed in the holes of the body of the guitar, a bridge having a fixed part joined to the body of the guitar and a pivoting part, such that the pivoting part is configured to rotate around the contact with the fixed part, wherein the strings are joined to the pivoting part such that the pivoting part is joined to the springs, and wherein the springs are fastened inside the holes.

6 Claims, 3 Drawing Sheets

VIBRATO SYSTEM FOR SOLID-BODY ELECTRIC GUITAR WITHOUT A HOUSING FOR VIBRATO

CROSS REFERENCE TO RELATED APPLICATION

This application claims the benefit of priority of Spanish Patent Application No. P 202030134, filed on Feb. 17, 2020, application which is incorporated herein in its entirety for all purposes.

FIELD OF THE INVENTION

The present invention relates to a vibrato system for solid-body electric guitars which lack a housing for vibrato, such that the vibrato system object of the invention enables, without needing to modify the body of the guitar, a vibrato mechanism to be coupled to the solid body of the guitar. The vibrato system for solid-body electric guitars without a housing for vibrato object of the invention is applicable in the music industry.

BACKGROUND OF THE INVENTION

An electric guitar is a musical instrument which normally has six strings and uses the principle of electromagnetic induction to convert the vibrations of the metal strings thereof into electrical signals.

The sound of the guitar is influenced by the design and location of the pickups, the scale and, to a lesser degree, by the bridge and the nut.

The bridge of the guitar is a fixed point which supports the strings of the guitar. In general, there are two types of bridges: fixed and mobile.

Fixed bridges are common in acoustic guitars, semi-acoustic guitars and many solid-body guitars. The designs of these guitars have in common that the tension of the strings is not modified momentarily while the instrument is being touched.

Vibrato bridges have a lever which projects from below the fastening point of the string. The musician can use the lever to modify the tension of the strings, and therefore modify the features of the sound.

In solid-body guitars with fixed bridges, the strings are joined at one end to the pegs of the headstock which enable the tuning thereof, run along the neck and reach the body of the guitar, through which, in the case of solid-body electric guitars without a housing for vibrato, they pass through holes from the front portion to the rear portion of the guitar, wherein they are fastened at the other end of the string to the aforementioned rear portion of the guitar.

There are solid-body guitars which have a housing to house a vibrato, but there is one model, the brand name being Fender Telecaster®, which is a solid-body guitar that lacks the aforementioned housing for vibrato and today, if this type of guitar with a fixed bridge is to be modified and a mobile bridge is to be installed which enables vibrato to be made, it is necessary to change the structure of the guitar with modifications on the body thereof which are irreversible that, in the best case, leave visible bores on the body of the guitar if the original guitar is to be had again, or in the worst case, they make it so a guitar with the original configuration having a solid body and fixed bridge cannot be had again.

SUMMARY OF THE INVENTION

The object of the invention is a vibrato system for a solid-body electric guitar without a housing for vibrato, which enables a vibrato mechanism or mobile bridge to be coupled to a solid-body guitar without needing to modify the body of the guitar.

One of the solid-body electric guitars that exists on the market comprises holes in the body, and a fixed bridge, which is replaced with the system object of the invention such that the solid-body guitar has a vibrato system without needing to modify the body of the guitar, which makes it lose the original features thereof.

The solid-body guitar without a housing for vibrato comprises a neck, a body which in turn comprises a plurality of holes, and a plurality of strings joined at one end to the neck.

The vibrato system for a solid-body electric guitar without a housing for vibrato object of the invention comprises springs housed in the holes of the body of the guitar, a bridge comprising a fixed part joined to the body of the guitar and a pivoting part resting on the fixed part, wherein the strings are joined to the pivoting part such that the pivoting part is joined to the springs, and wherein the springs are fastened inside the holes.

In the vibrato system for a solid-body electric guitar without a housing for vibrato object of the invention, the fixed part comprises a recess, the pivoting part comprises a sharp edge, wherein the pivoting part rests on the fixed part by means of the sharp edge resting on the recess of the fixed part.

In the vibrato system for a solid-body electric guitar without a housing for vibrato object of the invention, the pivoting part comprises a lever system configured to make the pivoting part rotate.

In the vibrato system for a solid-body electric guitar without a housing for vibrato object of the invention, the pivoting part comprises a housing for a lever configured to house one end of a lever.

The pivoting part of the vibrato system for a solid-body electric guitar without a housing for vibrato object of the invention comprises an L-shaped cross section, with a long branch and a short branch, such that the long branch houses a fastening to the springs, and the short branch comprises string through holes configured to enable the passage of the strings.

The vibrato system for a solid-body electric guitar without a housing for vibrato object of the invention comprises saddles such that each saddle is resting on a guide part.

In the vibrato system for a solid-body electric guitar without a housing for vibrato object of the invention, the fixed part comprises a housing for the electronics of the guitar and a series of screws to anchor the fixed part to the body of the guitar.

BRIEF DESCRIPTION OF THE DRAWINGS

To complement the following description and for the purpose of helping to better understand the features of the invention, a set of drawings is attached to the present specification on the basis of which the innovations and advantages of the object of the invention will be more readily understood.

THE NUMERICAL REFERENCES USED

Figure 1:
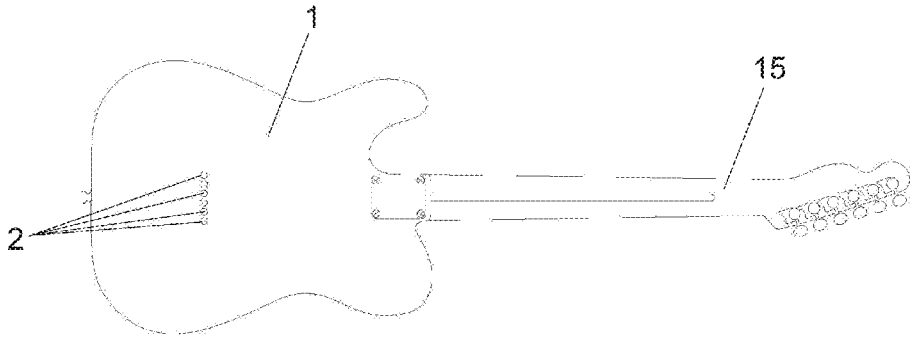
FIG. 1 shows a view of the rear portion of a solid-body guitar with a fixed bridge of the kind known in the state of the art.
Figure 2:
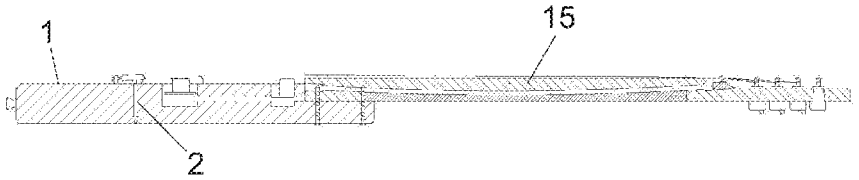
FIG. 2 shows a side view of a cross section of a solid-body guitar with a fixed bridge of the kind known in the state of the art.
Figure 3:
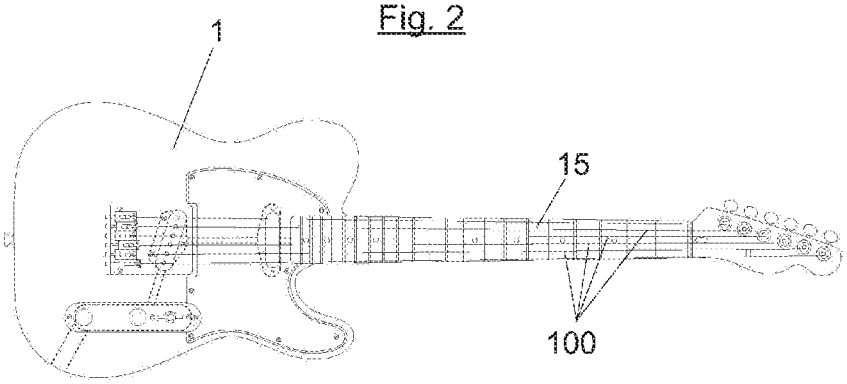
FIG. 3 shows a view of the front portion of a solid-body guitar with a fixed bridge of the kind known in the state of the art.
Figure 4:
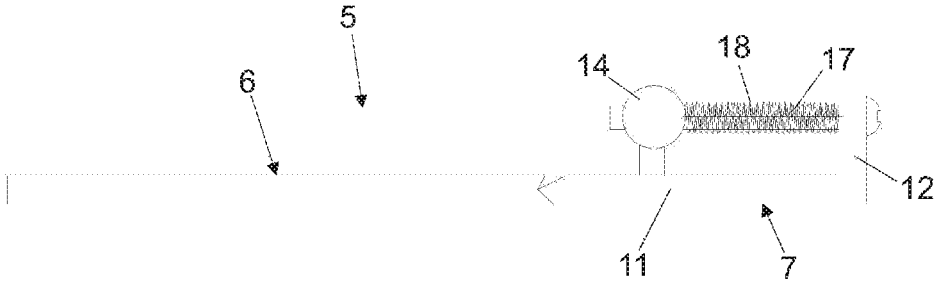
FIG. 4 shows a cross-sectional view of the bridge of the vibrato system for solid-body electric guitars.
Figure 5:
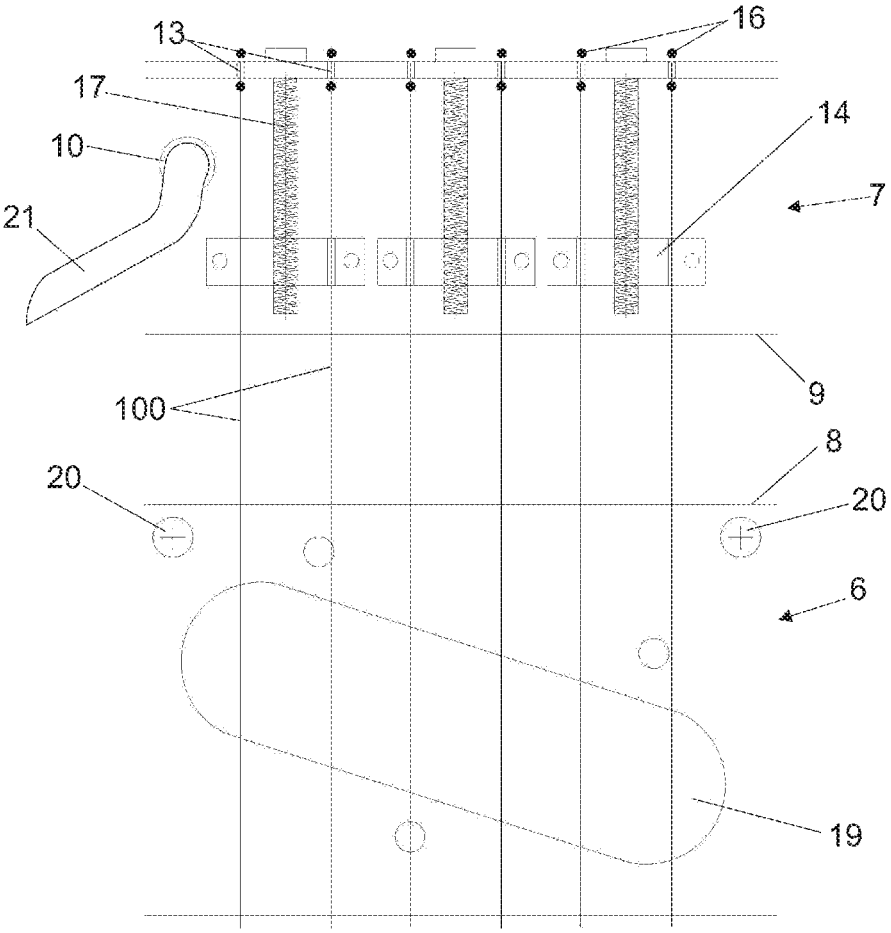
FIG. 5 shows an upper view of the bridge of the vibrato system for solid-body electric guitars.
Figure 6:
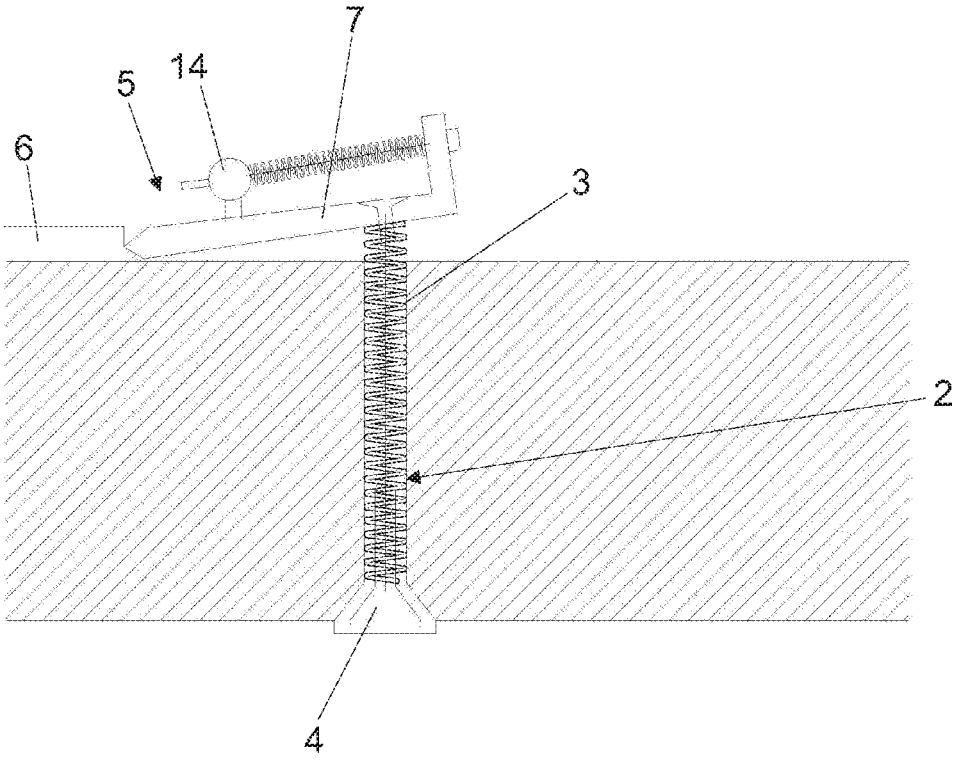
FIG. 6 shows a cross section of the body of the guitar, showing the springs together with the bridge formed by two parts attached to the body of the guitar.

1. body,
2. holes,
3. springs,
4. screws,
5. bridge,
6. fixed part,
7. pivoting part,
8. recess,
9. sharp edge,
10. housing for a lever,
11. long branch,
12. short branch,
13. string through holes,
14. saddles,
15. neck,
16. string stop,
17. guide part,
18. saddle spring,
19. housing for the electronics,
20. screws for anchoring the fixed part to the body,
21. lever, and
100. strings.

DETAILED DESCRIPTION OF THE INVENTION

The object of the invention is a vibrato system for a solid-body electric guitars which lack a housing for vibrato, which enables a vibrato mechanism or mobile bridge (5) to be coupled to this type of guitar without needing to modify the body (1) of the guitar.

A solid-body guitar without a housing for vibrato is known in the field of the invention as a Fender Telecaster®. Said guitar comprises holes (2) in the body (1) of the guitar which, in the aforementioned guitar, are intended to enable the strings (100) of the guitar to pass from the front portion to the rear portion, the aforementioned strings (100) being fastened in the rear portion of the guitar, such that the guitar lacks a vibrato system.

In the vibrato system for solid-body electric guitars without a housing for vibrato object of the invention, the holes (2) of the body (1) of the guitar are configured to house springs (3) which are fastened to the rear portion of the guitar, using screws (4) for this fastening in one embodiment of the invention.

The vibrato system for solid-body electric guitars without a housing for vibrato object of the invention comprises a bridge (5) formed by a fixed part (6) and a pivoting part (7), such that the fixed part (6) comprises a recess (8) in contact with the pivoting part (7) which in turn comprises a sharp edge (9) in contact with the recess (8) of the fixed part (6).

The pivoting part (7) comprises a housing for a lever (10) configured to house one end of a lever (21) which is responsible for making the vibrato in the guitar possible. Thus, the lever of the vibrato system for solid-body electric guitars is the object of the invention, which separates the strings (100) from the guitar, making the vibrato.

The pivoting part (7) comprises an L-shaped cross section, with a long branch (11) and a short branch (12). The short branch (12) comprises string through holes (13) configured to enable the passage of the strings (100) and which, by means of a stop (16) of each string (100), is fastened at one end to the aforementioned short branch (12). The long branch (11) houses the fastening to the springs (3) of the pivoting part (7) of the vibrato system object of the invention, wherein the springs (3) are housed in the holes (2) of the body of the guitar and fastened inside said holes (2), such that the springs (3) are the elements which the vibrato system needs in order to counteract the tension of the strings (100).

The pivoting part (7) comprises saddles (14) configured to tune the sound of the guitar, such that each saddle (14) is resting on a guide part (17) configured by a screw such that the guide part (17) enables the horizontal movement of the saddle (14). Additionally, a spring (18) is located around the guide part (17).

The fixed part (6) comprises a housing for the electronics (19) of the guitar and a series of screws (20) for anchoring the fixed part (6) to the body (1) of the guitar.

The invention claimed is:

1. A vibrato system for a solid-body electric guitar without a housing for vibrato, wherein the solid-body guitar without a housing for vibrato comprises:

a neck, a body, which in turn comprises a plurality of holes, and a plurality of strings joined at one end to the neck;

springs housed in the holes of the body of the guitar; and a bridge comprising a fixed part joined to the body of the guitar and a pivoting part resting on the fixed part, wherein the strings are joined to the pivoting part such that the pivoting part is joined to the springs, and wherein the springs are fastened inside the holes, the fixed part comprises a recess, the pivoting part comprises a sharp edge, and the pivoting part rests on the fixed part by means of the sharp edge resting on the recess of the fixed part.

2. The vibrato system for a solid-body electric guitar without a housing for vibrato according to claim 1, wherein the pivoting part comprises a lever system configured to make the pivoting part rotate.

3. The vibrato system for a solid-body electric guitar without a housing for vibrato according to claim 1, wherein the pivoting part comprises a housing for a lever configured to house one end of a lever.

4. The vibrato system for a solid-body electric guitar without a housing for vibrato according to claim 1, wherein the pivoting part comprises an L-shaped cross section, with a long branch and a short branch, such that the long branch houses a fastening to the springs, and the short branch comprises string through holes configured to enable the passage of the strings.

5. The vibrato system for a solid-body electric guitar without a housing for vibrato according to claim 4, further comprising saddles such that each saddle is resting on a guide part.

6. The vibrato system for a solid-body electric guitar without a housing for vibrato according to claim 1, wherein the fixed part comprises a housing for electronics of the guitar and a series of screws for anchoring the fixed part to the body of the guitar.

* * * * *